United States Patent [19]

Bennett

[11] 4,189,245

[45] Feb. 19, 1980

[54] SUCTION PRODUCING DISPOSABLE PUMP AND DISPENSER

[76] Inventor: Robert A. Bennett, 170 Sturbridge Rd., Easton, Conn. 06425

[21] Appl. No.: 900,990

[22] Filed: Apr. 28, 1978

[51] Int. Cl.[2] ..... A46B 11/00; A46B 11/02

[52] U.S. Cl. ..... 401/126; 401/129

[58] Field of Search ..... 401/118, 126–130, 401/122, 187–189; 132/88.7; 222/385

[56] References Cited

U.S. PATENT DOCUMENTS

| | | | |
|---|---|---|---|
| 1,021,622 | 3/1912 | Nelson | 401/120 |
| 3,311,941 | 4/1967 | Buchwalter et al. | 401/129 X |
| 3,554,657 | 1/1971 | Aston | 401/126 X |
| 3,951,157 | 4/1976 | Idec | 401/130 X |

FOREIGN PATENT DOCUMENTS

| | | | |
|---|---|---|---|
| 953504 | 12/1949 | France | 401/120 |

*Primary Examiner*—Edgar S. Burr
*Assistant Examiner*—Steven A. Bratlie

[57] ABSTRACT

A hollow casing having a vertical bore is inserted into the open neck of a container having liquid therein in such manner as to evacuate all air in the container other than the air in the neck. A piston having a brush at one end is moved into and out of the bore to charge the brush with a selected amount of liquid and to cause a lower portion of the bore to fill with liquid by suction action. A cap secured to the top of the piston and detachably engagable with the neck enables a user to manipulate the piston as desired.

1 Claim, 5 Drawing Figures

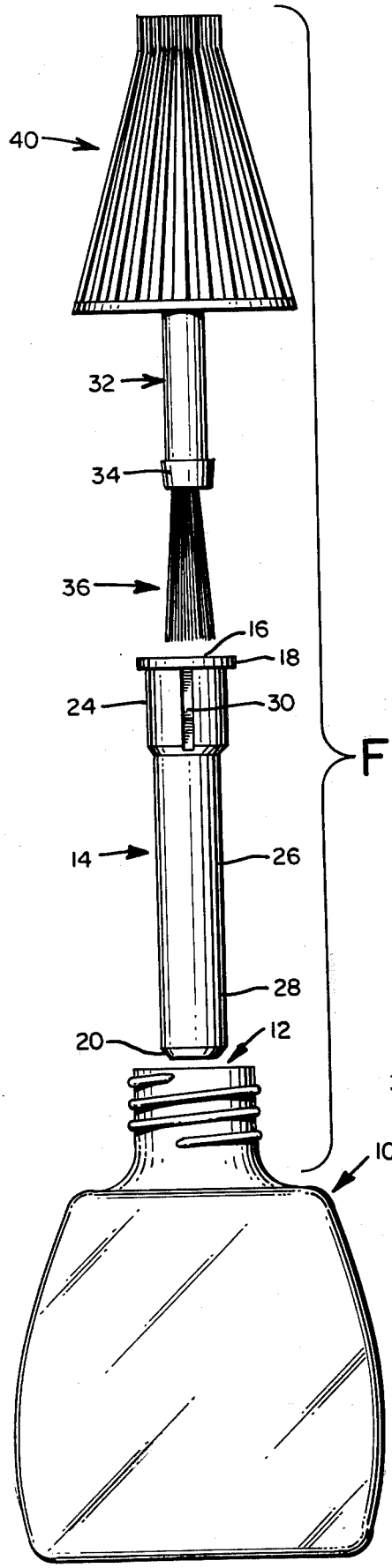
FIG. 1
FIG. 2
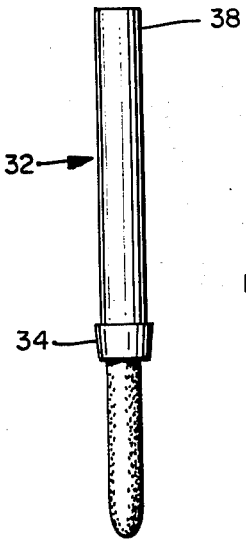
FIG. 3
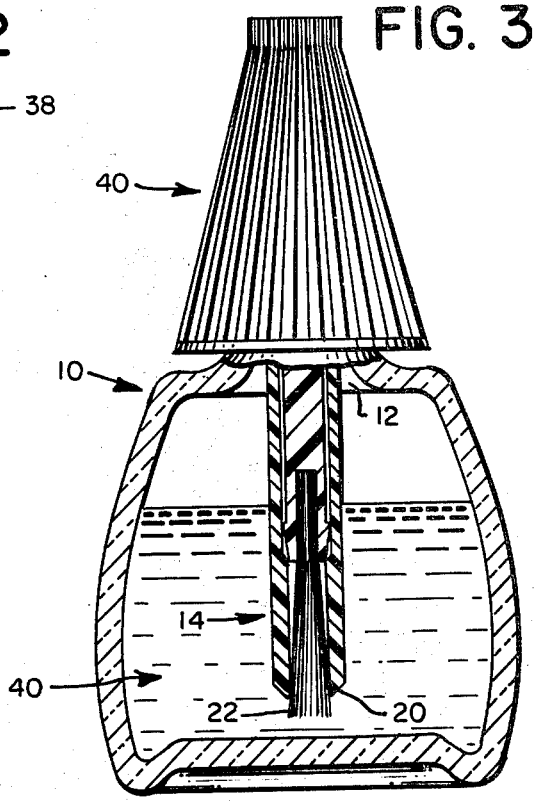
FIG. 4
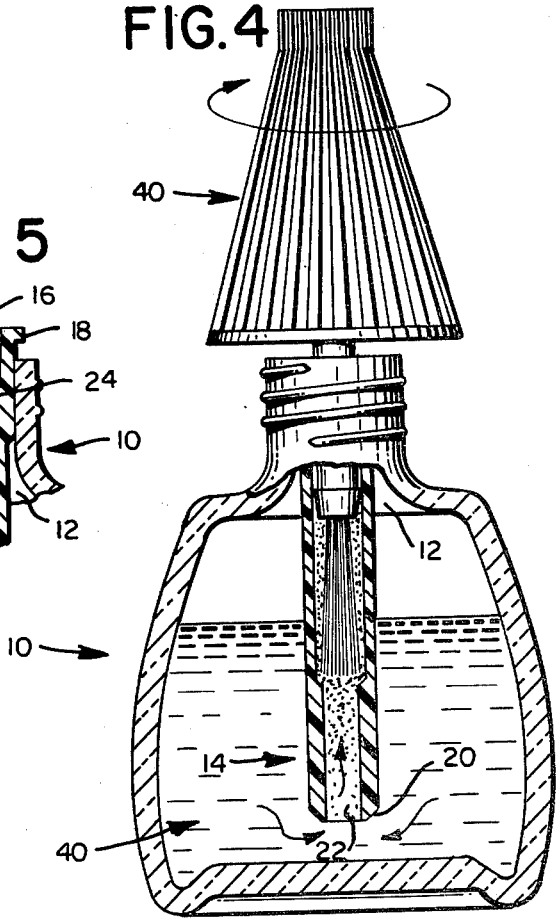
FIG. 5
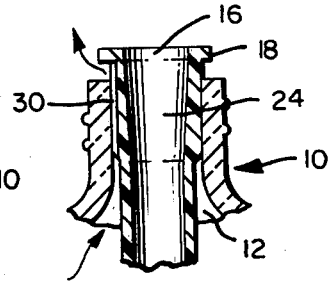

SUCTION PRODUCING DISPOSABLE PUMP AND DISPENSER

BACKGROUND OF THE INVENTION

It is often necessary to use a small brush to remove a small amount of fluid from a small bottle in order to subsequently transfer the fluid to a suitable surface. This technique is employed widely in the cosmetic field as for example wherein small bottles of nail polish have removable caps which in turn are secured to the tops of small brushes normally disposed in the nail polish liquid. The user unscrews the cap, removes the brush, and applies the polish to a nail. The brush is then clipped again into the fluid to recharge the bristles with fluid and the application process is repeated as often as necessary. However, each time the brush is removed from the bottle and reinserted, air is introduced into the bottle, causing the polish liquid to thicken and eventually to dry up. This process occurs so quickly that the liquid can dry up before the bottle is half empty. Nevertheless, at this point the polish cannot be used, and the bottle is thrown away. Even before the polish has dried up and has merely begun to thicken, the user may find the polish more difficult to apply because the polish does not flow sufficiently freely from the brush onto the nail.

The present invention overcomes these difficulties by using a suction producing disposable pump and dispenser which when inserted into a bottle of liquid causes the air to be evacuated therefrom and, in addition, prevents air from coming into contact with the liquid in the bottle during use whereby this liquid will not thicken and dry up; and the bottle can be emptied before it is thrown away.

SUMMARY OF THE INVENTION

A suction producing disposable pump and dispenser in accordance with the invention employs a vertically elongated hollow member having a top end with a circular opening therein having a first diameter and with an outwardly extending circular peripheral lip. The member has a bottom end with a circular opening therein having a second and smaller diameter, said ends being interconnected by a vertical bore having integral upper, middle and lower sections. The lower section defines a first cylinder having a diameter equal to said second diameter; the middle section defines a second cylinder having a third diameter which is intermediate the first and second diameters in size; and the upper section defines an inverted truncated core with an upper end having a diameter equal to said first diameter and with a lower end having a diameter equal to said third diameter. The member has an outer surface with a vertical groove therein extending upward to a point just below said lip.

The pump and dispenser further employs a vertically elongated cylindrical piston having a bottom enlarged end defining a third cylinder having a diameter larger than said second diameter and slightly smaller than said third diameter. The piston extends downwardly into the bore and is manually movable up and down therein between a raised position at which the piston is completely removed from the member and a lowered position at which said enlarged end engages the lower end of said second cylinder. The top end of the piston is always disposed above the lip when the piston is disposed in the member.

A plurality of elongated bristles are secured at their upper ends to the enlarged end of the piston and extend downward. These bristles, when the piston is in the lowered position, extend downwardly into the first cylinder of the bore to reach the opening in the bottom end of the member. A cap is secured to the top end of the piston.

In use, a container having an open neck is disposed in vertically upright position. The container is filled with liquid up to the bottom of the neck. The member with the piston disposed therein in lowest position is then forced downward into the neck until the lip rests upon the top of the neck. The clearance between the inner surface of the neck and the outer surface of that portion of the member in contact with the inner surface of the neck is such that an airtight seal is formed therebetween. The vertical groove allows any air which would otherwise be trapped in the container to escape therefrom as the member is inserted. The bottom end of the member is disposed well below the liquid level, very close to, but spaced above the bottom of the container. The cap is screwed onto the outer surface of the container. The container is then ready for use.

When the cap is unscrewed and the piston removed, a suction is developed which pulls the liquid into the first cylinder, that is the lower section of the member bore. This action constitutes priming the pump. Then the piston is reinserted and the bristles are charged with liquid. As the piston is then removed to allow the user to use the bristles to apply the liquid as, for example, as nail polish to finger nails, the suction is again developed whereby the lower section of the member bore is always charged with liquid. Eventually no air can come in contact with the liquid in the container whereby the liquid in the container cannot thicken and dry up and essentially all the liquid in the container can be used up before the container is thrown away.

BRIEF DESCRIPTION OF THE DRAWINGS

FIG. 1 is an exploded view of the parts used in the invention.

FIG. 2 is a vertical view of a modification of the structure of the brush of FIG. 1 wherein a felt tip is used instead of bristles.

FIG. 3 is a vertical cross-sectional view of the invention of FIG. 1 shown in closed position.

FIG. 4 is a view similar to FIG. 3 but showing the brush partially withdrawn.

FIG. 5 is an enlarged detail cross-sectional view of some of the parts shown in FIGS. 1, 3, and 4.

DETAILED DESCRIPTION OF PREFERRED EMBODIMENTS

Referring now to FIGS. 1–5, a container such as a glass bottle 10 has an open neck 12. A somewhat flexible vertically elongated member identified generally at 14 has a top end with a circular opening 16 therein and an outwardly extending circular peripheral lip 18. The member has a beveled bottom end 20 with a circular opening 22 therein. The member also has a centrally disposed vertical bore having integral upper section 24, middle section 26, and lower section 28.

Lower section 28 is a first cylinder having a diameter equal to that of opening 22. When the bottle is of typical size used in retail sale of nail polish, opening 22 can have a typical diameter of 0.140 inches. The middle section is a second cylinder having a diameter larger than that of section 28 and when the said typical size bottle is used, a typical diameter for the second cylinder is 0.176 inches. The upper section defines an inverted truncated cone with a top opening coincident with opening 16 and a bottom opening coincident with that of the second cylinder.

The member has a top portion which has an outer surface shaped to slide into and contact the inner surface of neck 12 in airtight sealing engagement. The remaining portion of the member has an outer surface smaller in diameter in order to slide easily into the bottle. The outer surface of the top portion has a vertical groove 30 which extends along the entire airtight seal and terminates below the lip. This groove, as described in more detail hereinafter, forms an air conduit.

A vertically elongated cylindrical piston 32 has an enlarged bottom head 34 with parallel vertical bristles 36 secured at their top ends in head 34 and extending downward. The piston has a top end 38 secured to cap 40. The piston can be inserted into the member and pressed down therein until head 34 bears against the lower end of the middle section 26 and bristles 36 bear against the bottom open end of the lower section 28. With the piston in this position and the member inserted into the bottle, the cap can be screwed onto the outer surface of the neck. Under these conditions, the lip bears against the top of the neck and the bottom end of the lower section is disposed adjacent but above the bottom of the bottle. The cap can be unscrewed to enable the piston and bristles to be removed from the member or replaced therein.

In use, a suitable liquid such as nail polish 40 is poured into the bottle until all but the neck is filled. Then the member with the piston disposed in lowest position therein is pushed downwardly through the neck into the liquid until the lip bears against the top end of the neck. The groove 30 allows any air trapped in the liquid to escape and the member and neck form the airtight seal previously discussed. The piston is then pulled out. The clearance between the inner wall of the middle section 26 is only large enough to permit easy sliding of the piston. For example, when the diameter of the middle section is 0.176 inches, the diameter of the enlarged head is 0.175 inches. As the piston is pulled out and the bristles are exposed, a suction force pulls the liquid into the lower section 28. Then when the piston and bristles are replaced, the bristles are disposed in section 28 and are charged with liquid.

Thus the bristles are always inserted to the same extent into the liquid-filled lower section and will thus always be charged with the same amount of liquid. The suction force developed when the piston and bristles are removed always fills the lower section 28 until the bottle is essentially empty. Essentially no air can come into contact with the liquid in the bottle whereby the thickening and drying actions are eliminated as previously described.

The piston, member, and cap typically can be formed of plastic as for example, polypropolene. A felt tip can be used in place of bristles.

I claim:

1. A suction producing disposable pump and dispenser in combination with a container having an open neck with liquid to be dispensed therein, the liquid filling essentially the entire container with the exception of said neck and comprising:

a vertically elongated hollow member having a top end with a circular opening therein having a first diameter and with an outwardly extending circular peripheral lip, said member having a bottom end with a circular opening therein having a second and smaller diameter, said ends being interconnected by a vertical bore having integral upper, middle and lower sections, said lower section defining a first cylinder having a diameter equal to said second diameter, said middle section defining a second cylinder having a third diameter which is intermediate the first and second diameters in size, said upper section defining an inverted truncated core with an upper end having a diameter equal to said first diameter and with a lower end having a diameter equal to said third diameter, the member having an outer surface with a vertical groove extending upward to a point just below said lip, said member being disposed in the container with the lip resting upon the top of the open neck and the outer surface of the member which is within the neck engaging the inner surface of the neck in airtight manner, the bottom of the member being only slightly above the bottom of the container, the groove extending upward along the entire length of the neck whereby insertion of said member in said container causes any air in the container below the neck to be expelled via said groove;

a vertically elongated cylindrical piston having a bottom enlarged end defining a third cylinder having a diameter larger than said second diameter, said piston extending downwardly into the bore and manually movable up and down therein between a raised position at which the piston is completely removed from the member and a lowered position at which said enlarged end engages the lower end of said second cylinder, the piston movement causing the first cylinder to be filled with fluid by suction;

a plurality of elongated parallel bristles secured at their upper ends to said enlarged end of the piston and extend downward, said bristles, when the piston is in the lowered position, extending downwardly into said first cylinder to reach the opening in the bottom end of said member, the bristles being charged with fluid when disposed in the first cylinder whereby when the piston is removed, the bristles can be used to transfer fluid charged thereon to a suitable surface; and a cap detachably securable to the outer surface of the neck of the container and secured to the top end of the piston, said cap when detached from the neck being manually operated to enable the piston and bristles to be removed from and replaced into the member.

* * * * *